US009783759B2

(12) United States Patent
Yao et al.

(10) Patent No.: US 9,783,759 B2
(45) Date of Patent: Oct. 10, 2017

(54) LIQUID ASHLESS ANTIOXIDANT ADDITIVE FOR LUBRICATING COMPOSITIONS

(71) Applicant: VANDERBILT CHEMICALS, LLC, Norwalk, CT (US)

(72) Inventors: Junbing Yao, Beijing (CN); Vincent Gatto, Milford, CT (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 0 days.

(21) Appl. No.: 14/826,540

(22) Filed: Aug. 14, 2015

(65) Prior Publication Data

US 2016/0068781 A1 Mar. 10, 2016

Related U.S. Application Data

(60) Provisional application No. 62/045,843, filed on Sep. 4, 2014.

(51) Int. Cl.

| | |
|---|---|
| ***C10M 169/00*** | (2006.01) |
| ***C10M 163/00*** | (2006.01) |
| ***C10M 141/08*** | (2006.01) |
| ***C11B 5/00*** | (2006.01) |

(52) U.S. Cl.

CPC ..... *C10M 163/00* (2013.01); *C10M 141/08* (2013.01); *C11B 5/005* (2013.01); *C11B 5/0035* (2013.01); *C10M 169/00* (2013.01); *C10M 2203/1025* (2013.01); *C10M 2205/0285* (2013.01); *C10M 2215/065* (2013.01); *C10M 2215/223* (2013.01); *C10M 2219/066* (2013.01); *C10N 2230/10* (2013.01);

(Continued)

(58) Field of Classification Search

CPC combination set(s) only.

See application file for complete search history.

(56) References Cited

U.S. PATENT DOCUMENTS

| | | | |
|---|---|---|---|
| 4,880,551 | A | 11/1989 | Doe |
| 5,726,135 | A | 3/1998 | Khorramian |
| 6,326,336 | B1 | 12/2001 | Gatto et al. |

(Continued)

FOREIGN PATENT DOCUMENTS

| | | | |
|---|---|---|---|
| EP | 1 006 173 A1 | 7/2000 | |
| GB | EP 1006173 A1 * | 6/2000 | ..... C10M 141/10 |

OTHER PUBLICATIONS

Duangkaewmanee et al., "Synergistic and Antagonistic Effects on Oxidation Stability of Antioxidants in a Synthetic Ester Based Oil", Tribology International 44(3): 266-271, 2011, Oct. 5, 2015.

(Continued)

*Primary Examiner* — Taiwo Oladapo

(74) *Attorney, Agent, or Firm* — Norris McLaughlin & Marcus, P.A.

(57) ABSTRACT

A lubricating composition comprising at least 90% by weight of a base oil, and an antioxidant composition comprising the components, set forth as weight % of the lubricating composition:

(1) solid alkylated-phenyl-alpha-naphthylamine at 0.01-0.3%, (2) an alkylated diphenylamine derivative of triazole, tolutriazole or benzotriazole, at 0.01-0.3%, and (3) methylenebis(di-n-butyldithiocarbamate), at 0.01-0.4%.

5 Claims, 1 Drawing Sheet

(52) U.S. Cl.
CPC ..... *C10N 2240/10* (2013.01); *C10N 2240/12* (2013.01); *C10N 2240/14* (2013.01); *C10N 2250/10* (2013.01)

(56) References Cited

U.S. PATENT DOCUMENTS

| | | | | |
|---|---|---|---|---|
| 6,599,865 | B1 | 7/2003 | Esche, Jr. et al. | |
| 6,743,759 | B2 | 6/2004 | Stunkel et al. | |
| 8,227,391 | B2 | 7/2012 | Ryan et al. | |
| 2003/0134753 | A1* | 7/2003 | Stunkel | C09K 15/30 508/281 |
| 2009/0001330 | A1* | 1/2009 | Arickx | C10M 171/00 252/574 |
| 2009/0054280 | A1 | 2/2009 | Sunkara et al. | |
| 2011/0124538 | A1 | 5/2011 | Karseboom et al. | |
| 2013/0252863 | A1 | 9/2013 | Cooper et al. | |
| 2014/0045736 | A1 | 2/2014 | Crawley et al. | |

OTHER PUBLICATIONS

International Search Report dated Oct. 5, 2015, dated Nov. 9, 2015.

* cited by examiner

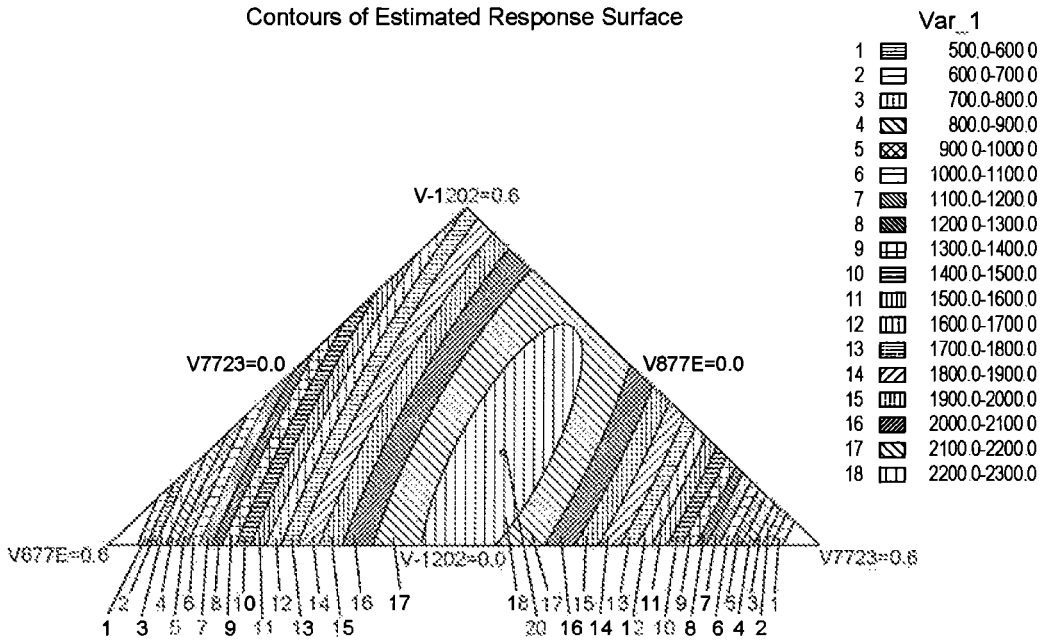
Contours of Estimated Response Surface
Var_1
1 500.0-600.0
2 600.0-700.0
3 700.0-800.0
4 800.0-900.0
5 900.0-1000.0
6 1000.0-1100.0
7 1100.0-1200.0
8 1200.0-1300.0
9 1300.0-1400.0
10 1400.0-1500.0
11 1500.0-1600.0
12 1600.0-1700.0
13 1700.0-1800.0
14 1800.0-1900.0
15 1900.0-2000.0
16 2000.0-2100.0
17 2100.0-2200.0
18 2200.0-2300.0
V-1202=0.6
V7723=0.0
V877E=0.0
V677E=0.6
V-1202=0.0
V7723=0.6

LIQUID ASHLESS ANTIOXIDANT ADDITIVE FOR LUBRICATING COMPOSITIONS

FIELD OF THE INVENTION

This application relates to improved antioxidant compositions and lubricating compositions containing the same.

BACKGROUND OF THE INVENTION

US patent application 2014/0045736 teaches an antioxidant and antiwear additive for lubricating compositions comprising an aromatic amine antioxidant in combination with an ashless dithiocarbamate. While alkylated phenyl-α-naphthylamine (APANA) is an aromatic amine antioxidant, no specific disclosure of this particular compound is suggested. Rather, only octylated or nonylated diphenylamine are specifically discussed.

U.S. Pat. No. 6,743,759 teaches the combination of ADPA derivative of tolutriazole and methylenebis(dibutyldithiocarbamate). Optional components include antioxidants, and APANA is among the list of literally dozens of possible antioxidant compounds, with no particular preference except for nonylated diphenylamine. No suggestion is made that the use of APANA in particular will provide a further synergy when used with the primary two-component composition of the reference.

SUMMARY OF THE INVENTION

Surprisingly, it has been discovered that improved antioxidant protection can be achieved by providing in a lubricating composition a three-component liquid antioxidant additive comprising (1) solid alkylated-phenyl-α-naphthylamine (APANA), (2) an alkylated diphenylamine (ADPA) derivative of triazole, tolutriazole or benzotriazole, and (3) methylenebis(di-n-butyldithiocarbamate). The additive may optionally further comprise a mineral oil or synthetic oil.

An antioxidant additive composition wherein the (1) solid alkylated-phenyl-α-naphthylamine, the (2) alklylated diphenylamine derivative of triazole, tolutriazole or benzotriazole and (3) methylenebis(di-n-butyldithiocarbamate) are each present at the following weight ratios: (1):(2):(3) being 1-13:1-13:1-13, preferably, 1-8:1-8:1-8, most preferably 1-2:0.125-1:1-2; optionally wherein the balance is a mineral oil or synthetic oil diluent.

A lubricating oil composition comprising a lubricating base at at least 90 wt. %, and an additive composition comprising, as part of the entire lubricating oil composition (1) alkylated-phenyl-α-naphthylamine at between 0.01 and 1.0 wt. %, preferably 0.10-0.50 wt. %, more preferably 0.15-0.30 wt. %; (2) alkylated diphenylamine derivative of triazole, tolutriazole or benzotriazole at 0.01 to 0.50 wt. %, preferably 0.01-0.30 wt. %, more preferably 0.01-0.15 wt. %; and (3) methylenebis(di-n-butyldithiocarbamate) at between 0.01 to 1.0 wt. %, preferably 0.10-0.50 wt. %, more preferably 0.15-0.3 wt %.

The alkylated phenyl-α-naphthylamine (APAN or APANA) may be linear or branched methylated, ethylated, propylated, butylated, pentylated, hexylated, heptylated, octylated, nonylated, decylated, undecylated, dodecylated, tridecylated, and tetra-decylated, preferably an octylated phenyl-α-naphthylamine. Commercial examples of alkylated phenyl-α-naphthylamines are Irganox® L-06 manufactured by BASF Corporation, VANLUBE® 1202 supplied by Vanderbilt Chemicals, LLC, and Naugalube® APAN manufactured by Chemtura Corporation.

The diphenylamine derivative of triazole, tolutriazole or benzotriazole is the reaction product of triazole, benzotriazole or tolutriazole with formaldehyde or paraformaldehyde and diphenylamine or alkylated diphenylamines. The alkylated diphenylamines may be linear or branched methylated, ethylated, propylated, butylated, pentylated, hexylated, heptylated, octylated, nonylated, decylated, undecylated, dodecylated, tridecylated, and tetra-decylated, preferably octylated diphenylamine. Commercial examples of diphenylamine derivatives of tolutriazole are VANLUBE® 887 (50 wt. % of an alkylated diphenylamine derivative of tolutriazole in mineral oil diluent) and VANLUBE® 887E (50 wt. % of an alkylated diphenylamine derivative of tolutriazole in synthetic ester diluent) manufactured by Vanderbilt Chemicals, LLC. The derivative may be made according to the teaching of U.S. Pat. No. 6,743,759, the contents of which are incorporated herein by reference.

Methylenebis(di-n-butyldithiocarbamate) may be Vanlube® 7723 manufactured by Vanderbilt Chemicals, LLC.

BRIEF DESCRIPTION OF THE DRAWINGS

FIG. 1 shows a contour plot generated from the data in Table 1.

DESCRIPTION OF THE INVENTION

The improved antioxidant additive composition of the invention may be incorporated in the lubricating compositions by known methods in an amount effective to produce the desired oxidation inhibiting characteristics. In one embodiment of the invention, the amount may range from about 0.01 to 5.0 percent by weight based on the total weight of the lubricating composition. In another embodiment of the invention, the amount range is about 0.1 to 3.0 percent of the additive based on the total weight of the lubricating composition. In a preferred embodiment, the additive is present at about 0.25 to 1.0 percent. The compositions impart metal deactivating as well as oxidation inhibiting properties to natural and synthetic lubricants formulated as oils or greases.

The base oils employed as lubricant vehicles are typical oils used in automotive and industrial applications such as, among others, turbine oils, hydraulic oils, compressor oils, heat transfer oils, transmission oils, automotive and industrial gear oils, greases, shock absorber fluids, metal working fluids, aviation oils, two-stroke engine oils, natural gas engine oils, marine oils, railroad oils, crankcase oils and diesel oils. Natural base oils include mineral oils, petroleum oils, and vegetable oils. The base oil may also be selected from oils derived from petroleum hydrocarbon and synthetic sources. The hydrocarbon base oil may be selected from naphthenic, aromatic, and paraffinic mineral oils. The synthetic oils may be selected from, among others, ester-type oils (such as silicate esters, pentaerythritol esters and carboxylic acid esters), severely hydrogenated mineral oils, silicones, silanes, polysiloxanes, alkylene polymers, poly-alpha-olefins and poly-alkylene-glycol ethers.

The lubricating compositions optionally contain the necessary ingredients to prepare the composition, as for example dispersing agents, emulsifiers, demulsifiers, and viscosity improvers. Greases may be prepared by adding thickeners, as for example salts and complexes of fatty acids, polyurea compounds, clays and quarternary ammonium bentonite. Depending on the intended use of the lubricant, other functional additives may be added to enhance a particular property of the lubricant.

The lubricating compositions may also contain one or more of the following additives:

1. Borated and/or non-borated ashless dispersants
2. Additional antioxidant compounds
3. Seal swell compositions
4. Organic and organo-metallic friction modifiers
5. Extreme pressure/antiwear agents
6. Viscosity modifiers
7. Pour point depressants
8. Metallic detergents
9. Phosphates
10. Antifoamants
11. Rust inhibitors
12. Copper corrosion inhibitors 1. Borated and/or Non-Borated Dispersants Non-borated ashless dispersants may be incorporated within the final fluid composition in an amount comprising up to 10 weight percent on an oil-free basis. Many types of ashless dispersants listed below are known in the art. Borated ashless dispersants may also be included.

(A) "Carboxylic dispersants" are reaction products of carboxylic acylating agents (acids, anhydrides, esters, etc.) containing at least about 34 and preferably at least about 54 carbon atoms reacted with nitrogen-containing compounds (such as amines), organic hydroxy compounds (such aliphatic compounds including monohydric and polyhydric alcohols, or aromatic compounds including phenols and naphthols), and/or basic inorganic materials. Examples of these "carboxylic dispersants" are described in British Patent 1,306,529 and in U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and Re 26,433, which are incorporated herein by reference for disclosure of carboxylic dispersants.

(B) "Amine dispersants" are reaction products of relatively high molecular weight aliphatic or alicyclic halides and amines, preferably polyalkylene polyamines. Examples thereof are described, for example, in U.S. Pat. Nos. 3,275,554, 3,438,757, 3,454,555, and 3,565,804 which are incorporated herein by reference for disclosure of amine dispersants.

(C) "Mannich dispersants" are the reaction products of alkyl phenols in which the alkyl group contains at least about 30 carbon atoms with aldehydes (especially formaldehyde) and amines (especially polyalkylene polyamines). The materials described in U.S. Pat. Nos. 3,036,003, 3,236,770, 3,414,347, 3,448,047, 3,539,633, 3,586,629, 3,591,598, 3,634,515, 3,725,480, and 3,726,882 are incorporated herein by reference for disclosure of Mannich dispersants.

(D) Post-treated dispersants are obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422 are incorporated herein by reference for disclosure of post-treated dispersants.

(E) Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants are disclosed in U.S. Pat. Nos. 3,329,658, 3,449,250, 3,519,656, 3,666,730, 3,687,849, and 3,702,300 which are incorporated herein by reference for disclosure of polymeric dispersants.

Borated dispersants are described in U.S. Pat. Nos. 3,087,936 and 3,254,025 which are incorporated herein by reference for disclosure of borated dispersants.

Also included as possible dispersant additives are those disclosed in U.S. Pat. Nos. 5,198,133 and 4,857,214 which are incorporated herein by reference. The dispersants of these patents compare the reaction products of an alkenyl succinimide or succinimide ashless dispersant with a phosphorus ester or with an inorganic phosphorus-containing acid or anhydride and a boron compound.

2. Additional Antioxidant Compounds

Other antioxidants may be used in the compositions of the present invention, if desired. Typical antioxidants include hindered phenolic antioxidants, secondary aromatic amine antioxidants, sulfurized phenolic antioxidants, oil-soluble copper compounds, organo-molybdenum compounds, phosphorus-containing antioxidants, organic sulfides, disulfides and polysulfides and the like.

Illustrative examples of sterically hindered phenolic antioxidants include ortho-alkylated phenolic compounds such as 2,6-di-tert-butylphenol, 4-methyl-2,6-di-tert-butylphenol, 2,4,6-tri-tert-butylphenol, 4-(N,N-dimethylaminomethyl)-2,6-di-tert-butylphenol, 4-ethyl-2,6-di-tertbutylphenol, 2,6-distyryl-4-nonylphenol, 1,6-hexamethylene-bis(3,5-di-tert-butyl-4-hydroxyhydrocinnamate), 3,5-di-tert-butyl-4-hydroxyhydrocinnamic acid, $C_{10}$-$C_{14}$ alkyl esters, 3,5-di-tert-butyl-4-hydroxyhydrocinnamic acid, $C_7$-$C_9$ alkyl esters, 3,5-di-tert-butyl-4-hydroxyhydrocinnamic acid, iso-octyl ester, 3,5-di-tert-butyl-4-hydroxyhydrocinnamic acid, butyl ester, 3,5-di-tert-butyl-hydroxyhydrocinnamic acid, methyl ester, tetrakis-(3-(3,5-di-tert-butyl-4-hydroxyphenyl)-propionyloxymethyl)methane, thiodiethylene bis(3,5-di-tert-butyl-4-hydroxyhydrocinnamate), octadecyl 3,5-di-tert-butyl-4-hydroxyhydrocinnamate, N,N'-bis(3,5-di-tert-butyl-4-hydroxyphenylpropionyl)hexamethylene diamine, N,N'-bis(3,5-di-tert-butyl-4-hydroxyphenylpropionyl)trimethylene diamine, N,N'-bis(3,5-di-tert-butyl-4-hydroxyphenylpropionyl) hydrazine and their analogs and homologs. Mixtures of two or more such hindered phenolic compounds are also suitable.

Other preferred hindered phenol antioxidants for use in the compositions of this invention are methylene-bridged alkylphenols, and these can be used singly or in combinations with each other, or in combinations with sterically-hindered unbridged phenolic compounds. Illustrative methylene-bridged compounds include 4,4'-methylenebis(6-tert-butyl-o-cresol), 4,4'-methylenebis(2-tert-amyl-o-cresol), 2,2'-methylenebis(4-methyl-6-tert-butylphenol), 4,4'-methylenebis(2,6-di-tert-butylphenol), and similar compounds. Particularly preferred are mixtures of methylene-bridged alkylphenols such as are described in U.S. Pat. No. 3,211,652, which is incorporated herein by reference.

Amine antioxidants, especially oil-soluble aromatic secondary amines may also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-β-naphthylamine, and phenyl-α-napthylamine.

A preferred type of aromatic amine antioxidant is an alkylated diphenylamine of the general formula:

$$R_1—C_6H_4—NH—C_6H_4—R_2$$

where $R_1$ is an alkyl group (preferably a branched alkyl group) having 4 to 12 carbon atoms, (more preferably 8 or 9 carbon atoms) and $R_2$ is a hydrogen atom or an alkyl group (preferably a branched alkyl group) having 4 to 12 carbon atoms, (more preferably 8 or 9 carbon atoms). Most preferably, $R_1$ and $R_2$ are the same. One such preferred compound is available commercially as Naugalube® 438L, a material which is understood to be predominately a 4,4'-dinonyldiphenylamine (i.e., bis(4-nonylphenyl)(amine)) in which the nonyl groups are branched. Another such preferred compound is available commercially as VANLUBE® 961 or IRGANOX® L57, a material which is understood to be a mixture of butylated and octylated alkylated diphenylamines.

Another useful type of antioxidant are 2,2,4-trimethyl-1,2-dihydroquinoline (TMDQ) polymers and homologs containing aromatized terminal units such as those described in U.S. Pat. No. 6,235,686, which is hereby incorporated by reference.

Mixtures of different antioxidants may also be used.

3. Seal Swell Compositions

Compositions which are designed to keep seals pliable are also well known in the art. A preferred seal swell composition is isodecyl sulfolane. The seal swell agent is preferably incorporated into the composition at about 0.1-3 weight percent. Substituted 3-alkoxysulfolanes are disclosed in U.S. Pat. No. 4,029,587 which is incorporated herein by reference.

4. Friction Modifiers

Friction modifiers are also well known to those skilled in the art. A useful list of friction modifiers are included in U.S. Pat. No. 4,792,410, which is incorporated herein by reference. U.S. Pat. No. 5,110,488 discloses metal salts of fatty acids and especially zinc salts and is incorporated herein by reference. Useful friction modifiers include fatty phosphites, fatty acid amides, fatty epoxides, borated fatty epoxides, fatty amines, glycerol esters, borated glycerol esters alkoxylated fatty amines, borated alkoxylated fatty amines, metal salts of fatty acids, sulfurized olefins, fatty imidazolines, molybdenum dithiocarbamates (e.g., U.S. Pat. No. 4,259,254, incorporated herein by reference), molybdate esters (e.g., U.S. Pat. No. 5,137,647 and U.S. Pat. No. 4,889,647, both incorporated herein by reference), molybdate amine with sulfur donors (e.g., U.S. Pat. No. 4,164,473 incorporated herein by reference), and mixtures thereof.

The preferred friction modifier is a borated fatty epoxide as previously mentioned as being included for its boron content. Friction modifiers are preferably included in the compositions in the amounts of 0.1-10 weight percent and may be a single friction modifier or mixtures of two or more.

5. Extreme Pressure/Antiwear Agents

Dialkyl dithiophosphate succinates may be added to provide antiwear protection. Zinc salts are preferably added as zinc salts of phosphorodithioic acids or dithiocarbamic acid. Among the preferred compounds for use are zinc, diisooctyl dithiophosphate and zinc dibenzyl dithiophosphate and amyl dithiocarbamic acid. Also included in lubricating compositions in the same weight percent range as the zinc salts to give antiwear/extreme pressure performance are dibutyl hydrogen phosphite (DBPH) and triphenyl monothiophosphate, and the thiocarbamate ester formed by reacting dibutyl amine-carbon disulfide- and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference. Antimony or lead salts may also be used for extreme pressure. The preferred salts are of dithiocarbamic acid such as antimony diamyldithiocarbamate. Examples of commercial anti-wear and Extreme Pressure agents that may be used include VANLUBE® 727, VANLUBE® 7611M, VANLUBE® 9123, VANLUBE® 871 and VANLUBE® 981 all manufactured by Vanderbilt Chemicals, LLC. Triaryl phosphates may also be used as antiwear additives and include triphenyl phosphate, tricresol phosphate and tri-butylatedphenyl phosphate.

6. Viscosity Modifiers

Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers. Summaries of viscosity modifiers can be found in U.S. Pat. Nos. 5,157,088, 5,256,752 and 5,395,539, which are incorporated herein by reference. The VMs and/or DVMs preferably are incorporated into the fully-formulated compositions at a level of up to 10% by weight.

7. Pour Point Depressants (PPD)

These components are particularly useful to improve low temperature qualities of lubricating oil. A preferred pour point depressant is an alkylnaphthalene. Pour point depressants are disclosed in U.S. Pat. Nos. 4,880,553 and 4,753,745, which are incorporated herein by reference. PPDs are commonly applied to lubricating compositions to reduce viscosity measured at low temperatures and low rates of shear. The pour point depressants are preferably used in the range of 0.1-5 weight percent.

8. Detergents

Lubricating compositions in many cases also preferably include detergents. Detergents as used herein are preferably metal salts of organic acids. The organic acid portion of the detergent is preferably a sulphonate, carboxylate, phenate, or salicylate. The metal portion of the detergent is preferably an alkali or alkaline earth metal. Preferred metals are sodium, calcium, potassium and magnesium. Preferably, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should preferably contain on average from about 10 to about 40 carbon atoms, more preferably from about 12 to about 36 carbon atoms and most preferably from about 14 to about 32 carton atoms on average. Similarly, the phenates, oxylates and carboxylates preferably have a substantially oleophilic character.

Examples of detergents can be found in U.S. Pat. Nos. 2,228,654, 2,250,188, 2,252,663, 2,865,956, 3,150,089, 3,256,186 and 3,410,798 which are incorporated herein by reference.

The amount of the overbased salt utilized in the composition is preferably from about 0.1 to about 10 weight percent on an oil free basis. The overbased salt is usually made up in about 50% oil with a TBN range of 10-600 on an oil free basis. Borated and non-borated overbased detergents are described in U.S. Pat. Nos. 5,403,501 and 4,792,410 which are herein incorporated by reference for disclosure pertinent hereto.

9. Phosphates

The lubricating compositions can also preferably include at least one phosphorus acid, phosphorus acid salt, phosphorus acid ester or derivative thereof including sulfur-containing analogs preferably in the amount of 0.002-1.0 weight percent. The phosphorus acids, salts, esters or derivatives thereof include compounds selected from phosphorus acid esters or salts thereof, phosphites, phosphorus-containing amides, phosphorus-containing carboxylic acids or esters, phosphorus containing ethers and mixtures thereof In one embodiment, the phosphorus acid, ester or derivative can be a phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids.

One class of compounds are adducts of O,O-dialkylphosphorodithioates and esters of maleic or fumaric acid. The compounds can be prepared by known methods as described in U.S. Pat. No. 3,359,203, as for example O,O-di(2-ethylhexyl) S-(1,2-dicarbobutoxyethyl) phosphorodithioate.

Another class of compounds useful to the invention are dithiophosphoric acid esters of carboxylic acid esters. Preferred are alkyl esters having 2 to 8 carbon atoms, as for example 3-[[bis(1-methylethoxy)phosphinothioyl]thio]propionic acid ethyl ester.

A third class of ashless dithiophosphates for use with the present invention include:

(i) those of the formula

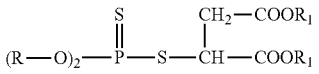

wherein R and $R_1$ are independently selected from alkyl groups having 3 to 8 carbon atoms (commercially available as VANLUBE 7611M, from R. T. Vanderbilt Co., Inc.);

(ii) dithiophosphoric acid esters of carboxylic acid such as those commercially available as IRGALUBE® 63 from BASF Corp.;

(iii) triphenylphosphorothionates such as those commercially available as IRGALUBE® TPPT from BASF Corp.; and 10. Antifoamants Antifoaming agents are well-known in the art as silicone or fluorosilicone compositions. Such antifoam agents are available from Dow Corning Corporation and Union Carbide Corporation. A preferred fluorosilicone antifoam product is Dow FS-1265. Preferred silicone antifoam products are Dow Corning DC-200 and Union Carbide UC-L45. Also, a siloxane polyether copolymer antifoamer available from OSI Specialties, Inc. of Farmington Hills, Mich. may also be included. One such material is sold as SILWET-L-7220. The antifoam products are preferably included in the compositions of this invention at a level of 5 to 80 parts per million with the active ingredient being on an oil-free basis.

11. Rust Inhibitors

Embodiments of rust inhibitors include metal salts of alkylnaphthalenesulfonic acids.

12. Copper Corrosion Inhibitors

Embodiments of copper corrosion inhibitors which may optionally be added include thiazoles, triazoles and thiadiazoles. Example embodiments of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles.

WORKING EXAMPLES

The following examples are given for the purpose of illustrating the invention and are not intended to limit the invention. All percentages and parts are based on weight unless otherwise indicated.

RPVOT Testing

The Rotating Pressure Vessel Oxidation Test (RPVOT, ASTM D 2272) is a turbine oil oxidation test used as a quality control tool for new and used turbine oils of known composition, as well as a research tool for estimating the oxidative stability of experimental oils. The test evaluates the oxidative stability of a turbine oil at elevated temperatures and oxygen pressures and in the presence of a copper coil oxidation catalyst and water. A rotating glass pressure vessel provides maximum oil-oxygen contact.

Results are reported as the time to a 25 psi drop in oxygen pressure. The test oil, copper coil and water are placed in the glass oxidation pressure vessel. The vessel is sealed and pressurized to 90 psi of oxygen. The pressurized vessel is placed in a high temperature bath maintained at 150° C. and continuously rotated throughout the test period. The test is monitored for consumption of oxygen. The time from the start of the test to the point when the pressure of the vessel has dropped 25 psi is defined as the oxidation life or oxidation induction time.

Example 1

In this series of experiments, test fluids were blended as defined in the table below. The APANA was an octylated phenyl-α-naphthylamine available commercially as Vanlube® 1202 from Vanderbilt Chemicals, LLC. ODPA derivative of tolutriazole is the octylated diphenylamine derivative of tolutriazole, 50% diluted in a polyol ester diluent, available commercially as Vanlube® 887E from Vanderbilt Chemicals, LLC. The methylenebis(dibutyldithiocarbamate) (MBDTC) is available commercially as Vanlube® 7723. The three additives were blended into an ISO 32 Group II base oil and tested in the RPVOT. Experiments were run in duplicate and the results averaged. The weight percentages given throughout are with respect to the entire lubricating composition including the base oil. The test results are presented in Table 1 below.

TABLE 1

| Oil ID | APANA (wt %) | ODPA derivative of tolutriazole* (wt %) | MBDTC (wt %) | Number of RPVOT tests | RPVOT Life (average in minutes) | Synergistic Effect (minutes above expected value) |
|---|---|---|---|---|---|---|
| A | 0.6 | | | 2 | 1719 | NR |
| B | | | 0.6 | 2 | 78 | NR |
| C | | 0.3 | | 2 | 179 | NR |
| D | 0.3 | | 0.3 | 2 | 2011 | 1113 |
| E | 0.3 | 0.15 | | 2 | 1130 | 181 |
| F | | 0.15 | 0.3 | 2 | 2180 | 2052 |
| G (invention) | 0.2 | 0.1 | 0.2 | 2 | 2299 | 0 |

*ODPA derivative of tolutrizole is present as a 50 wt. % diluted in Polyol ester HATCOL 2965. The data shown here and throughout the other tables is given as weight % of the ODPA derivative of tolutriazole alone.

Note from the test results in Table 1 that the best performing oil was that which contained all three additives, the APANA, the ODPA derivative of tolutriazole and the MBDTC. The results in the table below show antioxidant synergies that exist: (1) synergy between APANA and ODPA derivative of tolutriazole, (2) synergy between APANA and MBDTC, and (3) synergy between ODPA derivative of tolutriazole and MBDTC.

FIG. 1 shows a contour plot generated from the data in Table 1 using a statistical analysis program called Statgraphics Centurion XVI Version 16.2.04 (64-bit). The program takes data from designed experiments like that in Table 1 and provides response surface analyses in the form of contour plots where each series of lines represents an increase in response or performance. The cross near the center of the contour plot represents the maximum response possible in the series of experiments. Note the maximum response comes very close to the mid-point of the plot which is the area where all three components are present.

Example 2

In this series of experiments shown in Table 2, different tolutriazoles were tested and compared to the ODPA derivative of tolutriazole. Test fluids were blended as defined in the table below. The APANA is octylated phenyl-α-naphthylamine available commercially as Vanlube® 1202 from Vanderbilt Chemicals, LLC. Note that the concentrations of the tolutriazole and derivatives of tolutriazoles varied in the formulations. These additives were blended at equal nitrogen content in order to maintain equivalent activity in these experiments. In these blends the 2EHA (2-ethyl hexamine) derivative of tolutriazole is a bis(2-ethylhexylamine) derivative of tolutriazole available commercially as Cuvan® 303 from Vanderbilt Chemicals, LLC. The additives were blended into an ISO 32 Group II base oil in the presence of 0.2 wt. % of a rust inhibitor Vanlube® RI-A commercially available from Vanderbilt Chemicals, LLC and tested in the RPVOT. Experiments were run in duplicate and the results averaged. The test results are presented below.

TABLE 2

| Oil ID | Tolutriazole or Tolutriazole derivative Type | Tolutriazole or Tolutriazole derivative, Wt % | Tolutriazole component wt % (by wt % nitrogen) | APANA, Wt % | MBDTC, Wt % | Number of RPVOT Tests | RPVOT Life (average in minutes) |
|---|---|---|---|---|---|---|---|
| H (invention) | ODPA derivative of tolutriazole | 0.15 | 0.0162 | 0.15 | 0.15 | 2 | 1580 |
| I | 2EHA derivative of tolutriazole | 0.112 | 0.0162 | 0.15 | 0.15 | 2 | 1430 |
| J | tolutriazole | 0.0513 | 0.0162 | 0.15 | 0.15 | 2 | 1630 |
| K (invention) | ODPA derivative of tolutriazole | 0.075 | 0.0081 | 0.15 | 0.3 | 2 | 2218 |
| L | 2EHA derivative of tolutriazole | 0.056 | 0.0081 | 0.15 | 0.3 | 2 | 1375 |
| M | tolutriazole | 0.0256 | 0.0081 | 0.15 | 0.3 | 2 | 1671 |

The results show that the ODPA derivative of tolutriazole performs better than the 2EHA derivative of tolutriazole in both blends (H versus I and K versus L). The ODPA derivative of tolutriazole performs better than tolutriazole itself in one blend (K versus M) and equivalent to tolutriazole in the other blend (H versus J). However, it should be pointed out that tolutriazole itself is not a practical additive to use in turbine oils and lubricants in general due to its very limited solubility.

Example 3

In this series of experiments shown in Table 3, different antioxidants were tested and compared to the APANA (same compound as in Example 2). Test fluids were blended as defined in the table below. In these blends NDPA is nonylated diphenylamine available commercially as Naugalube® 438L from Chemtura Corporation, MBDTBP is 4,4'-methylenebis(2,6-di-tert-butylphenol) available commercially as ETHANOX® 4702 from SI Group, 2,6-

DTBP is 2,6-di-tert-butylphenol, and TMQ is 2,2,4-Trimethyl-1,2-Dihydroquinoline polymer available commercially as Vanlube® RD from Vanderbilt Chemicals, LLC. The additives were blended into an ISO 32 Group II base oil in the presence of 0.2 wt. % of a rust inhibitor Vanlube® RI-A commercially available from Vanderbilt Chemicals, LLC and tested in the RPVOT as defined below. The test results are presented below.

TABLE 3

| Oil ID | Antioxidant Type | Antioxidant Wt % | ODPA derivative of tolutriazole (Wt %) | MBDTC (Wt %) | Number of RPVOT tests | RPVOT Life (average in minutes) |
|---|---|---|---|---|---|---|
| N (invention) | APANA | 0.15 | 0.15 | 0.15 | 2 | 1580 |
| O | NDPA | 0.15 | 0.15 | 0.15 | 3 | 1325 |
| P | MBDTBP | 0.15 | 0.15 | 0.15 | 3 | 883 |
| Q | 2,6-DTBP | 0.15 | 0.15 | 0.15 | 2 | 1081 |
| R | TMQ | 0.15 | 0.15 | 0.15 | 2 | 837 |
| S (invention) | APANA | 0.15 | 0.075 | 0.3 | 2 | 2218 |
| T | NDPA | 0.15 | 0.075 | 0.3 | 2 | 1797 |
| U | MBDTBP | 0.15 | 0.075 | 0.3 | 2 | 1054 |
| V | 2,6-DTBP | 0.15 | 0.075 | 0.3 | 2 | 1385 |
| W | TMQ | 0.15 | 0.075 | 0.3 | 2 | 1173 |

The results show that the inventive blend containing APANA performs better than the non-inventive blends containing other commonly used lubricant antioxidants (N versus O, P, Q and R, and S versus T, U, V and W). It should be pointed out that TMQ itself is not a practical additive to use in turbine oils due to its limited solubility.

Example 4

In this series of experiments shown in Table 4, the various additives were blended into a 650 solvent neutral Group I base oil. No other additives were present. The blends were prepared as defined below. In these blends APANA * is octylated phenyl-α-naphthylamine available commercially as Irganox® L 06 from BASF Corporation, and APANA ** is octylated phenyl-α-napthylamine available commercially as Vanlube 1202® from Vanderbilt Chemicals, LLC. Results of the RPVOT testing are shown below:

TABLE 4

| Oil ID | APANA (wt %) | ODPA derivative of tolutriazole (wt %) | MBDTC (wt %) | Number of RPVOT tests | RPVOT Life (average in minutes) |
|---|---|---|---|---|---|
| X (baseoil only) | | | | 1 | 20 |
| Y | 0.5 * | | | 2 | 148 |
| Z | 0.5** | | | 2 | 138 |
| AA | | 0.0375 | 0.425 | 1 | 268 |
| AB | | | 0.5 | 1 | 94 |
| AC (invention) | 0.25* | 0.01875 | 0.2125 | 1 | 323 |
| AD | 0.25* | | 0.25 | 1 | 178 |
| AE (invention) | 0.25** | 0.01875 | 0.2125 | 1 | 330 |
| AF | 0.25** | | 0.25 | 1 | 179 |

The results clearly show that the three way combination of APANA, ODPA derivative of tolutriazole, and MBDTC is a significantly better antioxidant compared to the non-inventive examples.

PDSC Testing

Pressurized Differential Scanning calorimetry (PDSC) is a commonly used technique for evaluating a wide variety of engine and industrial lubricating oils. The simplicity of the test combined with its excellent repeatability and the ability to easily modify test conditions, makes it a valuable tool for quality control and lubricant research. The test evaluates the oxidative stability of a thin-film of lubricant under high temperature and high oxygen pressures. Results are generally reported as the induction time to an exothermic release of heat caused by oxidation of the thin-film of oil. A thin-film of oil is placed in a sample holder and then added to the DSC pressure cell. The cell is pressurized with the specified gas and subjected to a specified heating sequence that is accurately controlled by the DSC computer control system. The most commonly used heating sequence is the isothermal method. The experiment is run until an exothermic release of heat is observed. The time from the start of the experiment to the exothermic release of heat represents the onset to oil oxidation and is reported as the oxidation induction time. The standardized test procedure ASTM D 6186, Standard Test Method for Oxidation Induction Time of Lubricating Oils by Pressure Differential Scanning calorimetry (PDSC) was the test procedure utilized in the following examples.

Example 5

In this series of experiments shown in Table 5, the various additives were blended into a PAO 6 cSt. Group IV base oil. No other additives were present. The blends were prepared as defined below. PDSC testing was performed in the isothermal mode at 180° C.

TABLE 5

| Oil ID | APANA (wt %) | ODPA derivative of tolutriazole (wt %) | MBDTC (wt %) | Number of PDSC tests | PDSC OIT (average in minutes) |
|---|---|---|---|---|---|
| AG (baseoil only) | | | | 1 | 0 |
| AH | 0.5 * | | | 2 | 94 |
| AI | 0.5** | | | 2 | 94 |
| AJ | | 0.0375 | 0.425 | 1 | 36 |
| AK | | | 0.5 | 1 | 6 |
| AL | | 0.25 | | 1 | 14 |
| AM (invention) | 0.25* | 0.01875 | 0.2125 | 2 | 96 |

TABLE 5-continued

| Oil ID | APANA (wt %) | ODPA derivative of tolutriazole (wt %) | MBDTC (wt %) | Number of PDSC tests | PDSC OIT (average in minutes) |
|---|---|---|---|---|---|
| AN | 0.25* | | 0.25 | 2 | 70 |
| AO (invention) | 0.25** | 0.01875 | 0.2125 | 1 | 99 |
| AP | 0.25** | | 0.25 | 2 | 92 |

The results show that the three way combination of APANA, ODPA derivative of tolutriazole, and MBDTC performs better than most other combinations (AM and AO versus AJ, AK, AL, AN and AP) and about the same as the APANA's alone (AM and AO versus AH and AI). It is pointed out that the APANA's have two key negative attributes when used alone that make the three way combination much more desirable. These are (1) the APANA's are solids that are difficult to handle and blend into lubricants, and (2) the APANA's used by themselves provide a finished lubricant formulation that is considerably cost prohibitive. While a blend of APANA/ODPA derivative of tolutriazole/MBDTC as described in this invention and examples AM and AO is a liquid product that blends readily in lubricating oils. It is additionally noted that the two component AP example, while providing acceptable results, is also in the form of a solid.

What is claimed is:

1. A lubricating composition comprising at least 90% by weight of a lubricant base, and a liquid antioxidant composition formed by blending the following components, set forth as weight % of the lubricating composition:

octylated-phenyl-α-naphthylamine at about 0.05 to about 0.25%, an octylated diphenylamine derivative of triazole, tolutriazole or benzotriazole, at about 0.025 to about 0.125%, and methylenebis(di-n-butyldithiocarbamate), at about 0.1 to about 0.5%.

2. The lubricating composition of claim 1, wherein the lubricant base is chosen from one of a grease, turbine oil, compressor oil, industrial lubricating oil and engine lubricating oil.

3. The lubricating composition of claim 2, wherein the lubricant base is a grease or turbine oil.

4. The lubricating composition of claim 1, further comprising one or more additives selected from dispersants, detergents, friction modifiers, corrosion inhibitors, rust inhibitors, anti-wear additives, pour point depressants, viscosity index modifiers, supplemental antioxidants and extreme pressure additives.

5. The lubricating composition of claim 4, where the supplemental antioxidants are selected from alkylated diphenylamine antioxidants and hindered phenolic antioxidants.

* * * * *